US008096447B2

(12) United States Patent
Liberatore

(10) Patent No.: US 8,096,447 B2
(45) Date of Patent: Jan. 17, 2012

(54) DEFORMABLE TUBE WINDING DEVICE

(76) Inventor: Raymond A. Liberatore, Bentonville, AR (US)

( * ) Notice: Subject to any disclaimer, the term of this patent is extended or adjusted under 35 U.S.C. 154(b) by 0 days.

(21) Appl. No.: 12/952,612

(22) Filed: Nov. 23, 2010

(65) Prior Publication Data

US 2011/0062184 A1 Mar. 17, 2011

Related U.S. Application Data

(63) Continuation-in-part of application No. 12/045,688, filed on Mar. 10, 2008, now Pat. No. 7,837,068, which is a continuation of application No. 11/226,175, filed on Sep. 15, 2005, now abandoned, application No. 12/952,612, which is a continuation of application No. 29/364,873, filed on Jun. 30, 2010, now Pat. No. Des. 628,840.

(51) Int. Cl.
*B65D 35/34* (2006.01)

(52) U.S. Cl. ..... 222/100

(58) Field of Classification Search ..... 222/95, 222/97–100

See application file for complete search history.

(56) References Cited

U.S. PATENT DOCUMENTS

| | | | | |
|---|---|---|---|---|
| 1,990,929 | A | 2/1935 | Bonham | |
| D150,885 | S | 9/1948 | Richardson | |
| 2,747,772 | A | 5/1956 | Ernst | |
| 3,219,238 | A | 11/1965 | Borkenhagen et al. | |
| 3,473,698 | A | 10/1969 | Bailin | |
| 5,097,987 | A | 3/1992 | Liberatore | |
| 5,215,223 | A * | 6/1993 | Lee | 222/100 |
| D378,557 | S | 3/1997 | Tal | |
| 5,642,839 | A * | 7/1997 | Lee | 222/99 |
| RE35,587 | E * | 8/1997 | Okamura et al. | 222/100 |
| 5,685,457 | A | 11/1997 | Liberatore | |
| 5,960,994 | A | 10/1999 | Liberatore | |
| 6,247,618 | B1 | 6/2001 | Liberatore | |
| D543,751 | S | 6/2007 | Rendzio | |
| D554,985 | S | 11/2007 | Tal | |
| D587,050 | S | 2/2009 | Behan | |
| 2006/0138167 | A1 * | 6/2006 | McMahon et al. | 222/100 |

* cited by examiner

*Primary Examiner* — J. Casimer Jacyna
(74) *Attorney, Agent, or Firm* — Myers Wolin, LLC

(57) ABSTRACT

A wind-up device for use with a dispenser including: a body, a gripper inserted into the body, and a brake disposed between the body and the gripper for controlling the direction of rotation of the gripper relative to the body; the brake further comprises a plurality of fingers for engaging a plurality of notches on one of the body or the gripper; wherein rotation of the gripper relative to the body causes the fingers to engage and disengage with the notches at spaced-apart intervals.

14 Claims, 18 Drawing Sheets

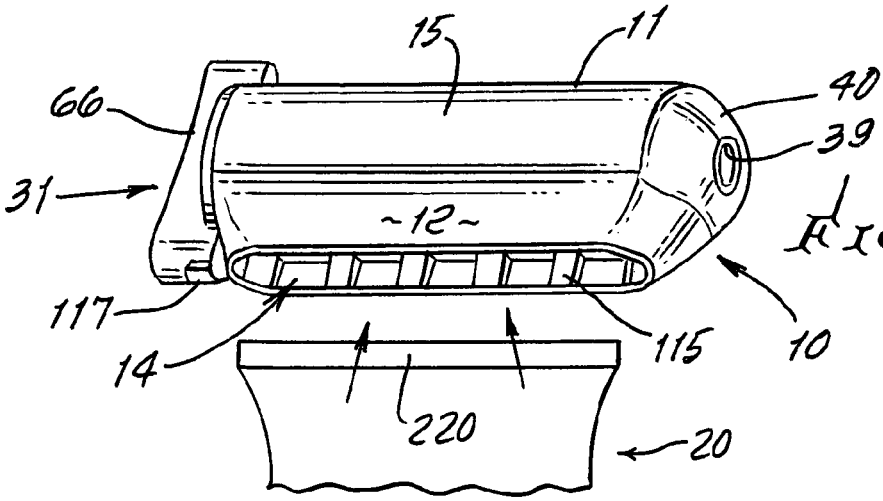
FIG. 1.
FIG. 2.
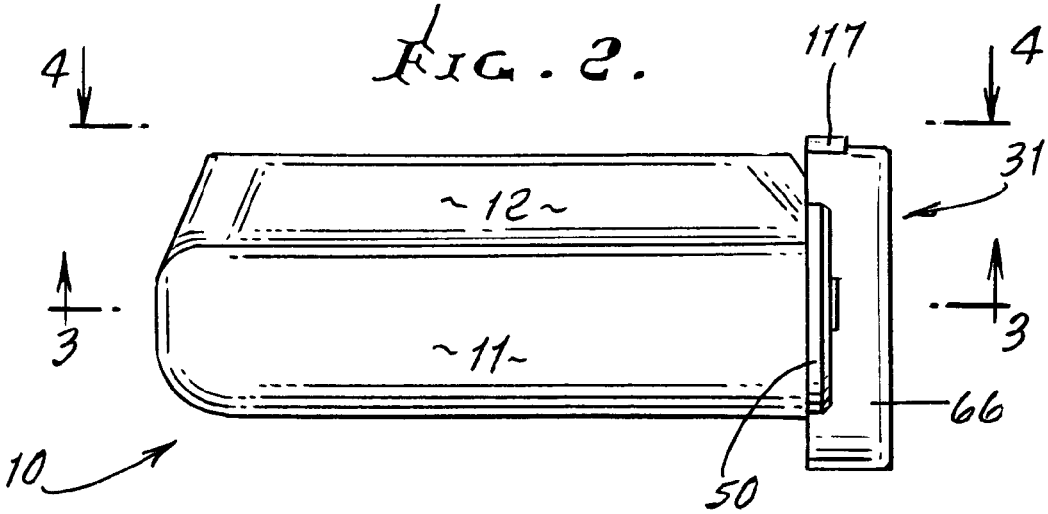
FIG. 3.
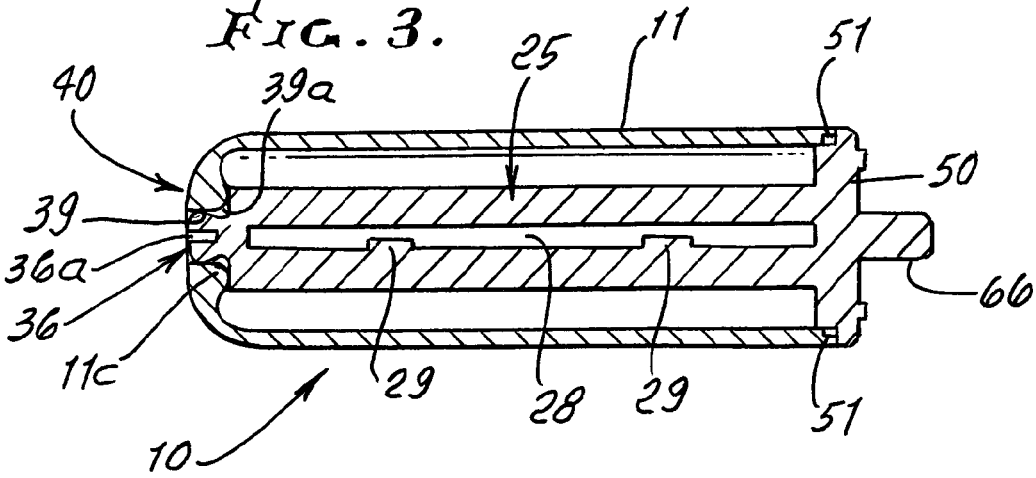

FIG. 7.
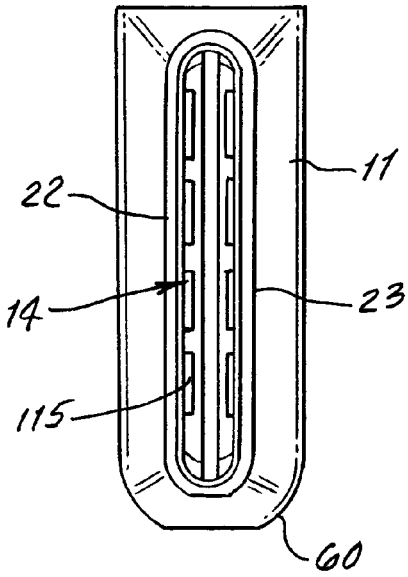
FIG. 8.
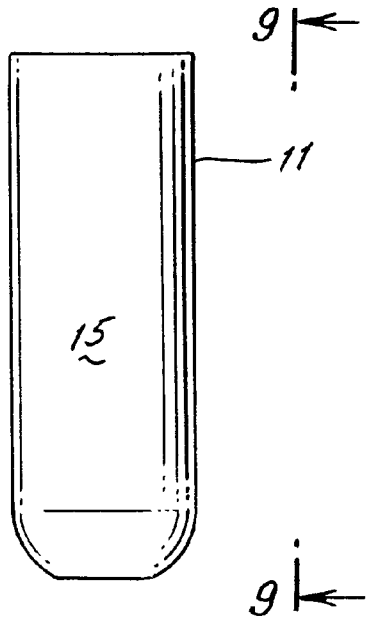
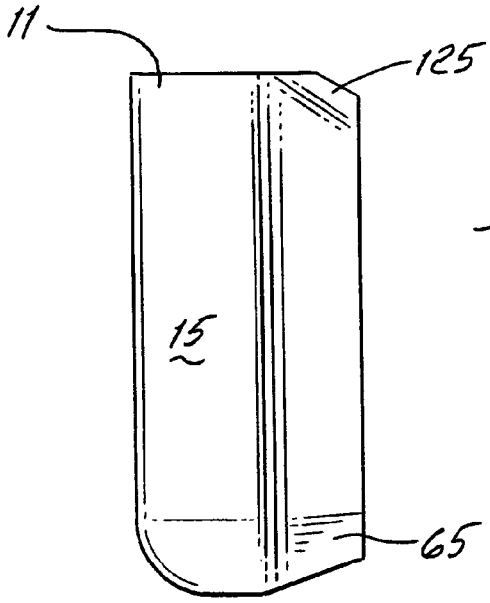
FIG. 9.

FIG. 18.
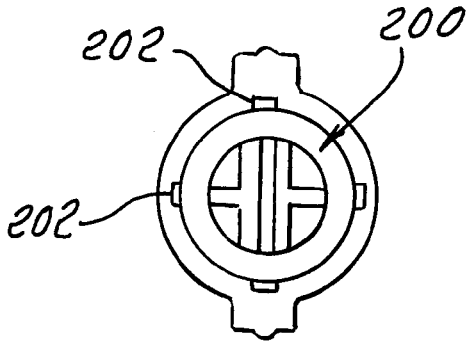
FIG. 19.
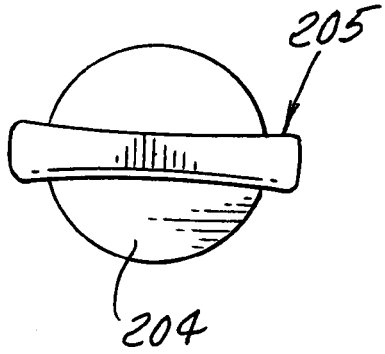
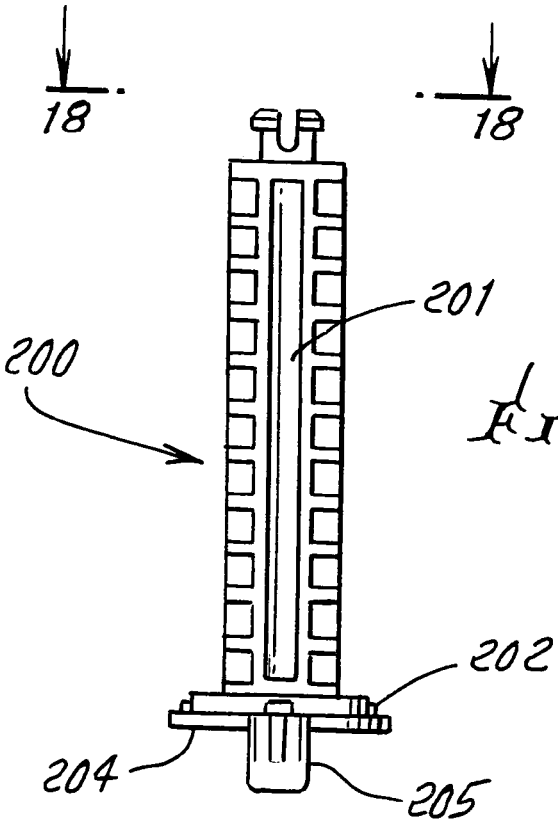
FIG. 17.

DEFORMABLE TUBE WINDING DEVICE

CROSS REFERENCE TO RELATED APPLICATIONS

This is a continuation-in-part of (1) U.S. application Ser. No. 12/045,688, filed Mar. 10, 2008, which is a continuation of U.S. application Ser. No. 11/226,175, filed Sep. 15, 2005, now abandoned, and (2) U.S. application Ser. No. 29/364,873, filed Jun. 30, 2010. The contents of each of the above applications are incorporated herein by reference in its entirety.

BACKGROUND OF THE INVENTION

This invention relates generally to dispensers and devices usable to roll-up dispensers for products that are dispensable as by container squeezing and evacuating contents out of the dispenser or tube; and more particularly concerns easily operable toothpaste tube and other type of tubes and roll-up devices of improved construction and operation.

There is continual need for improvements in tubes and devices as referred to, i.e. devices that are sturdier, more easily handled, more efficient in operation, and less expensive, and also devices having improvements in construction and function, as disclosed herein. For example, one problem with existing tube roll-up devices is that the reel within the device may spin freely, which may allow the tube to unravel and unwind. Another problem to be solved involves the crimped end of the tube, which serves no function with respect to egress of the tube contents.

SUMMARY OF THE INVENTION

It is an object of the invention to provide an improved device to roll-up a squeezable container, such as a toothpaste tube or any type of tube. Basically, the improved device comprises a) a longitudinally elongated hollow body having opposite, substantially flat exterior sides tapering laterally toward an elongated body inlet at one lateral extremity of the body, b) the body having an outwardly enlarged, manually grippable, first domed exterior surface at the opposite lateral extremity thereof and merging with said flat sides, the body having opposite ends, c) the inlet sized to progressively receive and guide a tube closed end portion into the body interior, and there being an elongated dispenser tube reel type gripper in the body interior to grip the tube closed end portion, for rotation and progressive wind-up, d) and a winder at one end of the body and operatively connected with the gripper, for rotating the gripper for winding the tube closed end, and the flattened tube extent within the body interior, e) the opposite end of the body having an endwise second domed outer surface, for nesting in the palm of the hand of the user, that second domed surface merging with the first domed surface and with the flat tapering exterior sides.

Another object is to provide a tube gripper that is longitudinally elongated in the body interior to extend parallel to the elongated inlet, the body defining tube deforming surfaces that taper at the inlet toward the gripper within the body interior, and means supporting the gripper at said second domed end of the body. The gripper may be generally cylindrical, and have an elongated slot therein to receive the end of the tube, the gripper having multiple edges to engage the tube.

A further object is to provide an improved winder that includes an externally protruding, transversely elongated knob, and a carrier for the knob, the carrier and body forming frictionally interfering surfaces to act as a brake to retain the tube in selected wound position, the body having a tapered shoulder extending from a location proximate the carrier to a location proximate an end of said inlet, that shoulder facing the path of rotation of one end of the winder.

Yet another object is to provide an improved carrier that defines a disc extending in a plane normal to an axis of rotation defined by the winder, the knob outstanding from the disc, the frictionally interfering surface of the carrier located proximate the periphery of the disc. The improved knob typically extends parallel to the disc and has opposite ends that extend beyond the disc periphery. Also, a mid-portion of the knob may have a venturi-shaped mid-portion of reduced width, relative to the width of the knob opposite ends. In this regard, each opposite end of the knob may be beveled at opposite sides of the knob for thumb and finger accurate positioning to assist knob rotation.

An additional object is to provide the body slot with opposed walls that taper toward the gripper, and with guide grooves in those walls, that also taper toward the gripper and which are exposed for guiding contact with a deformable tube being wound.

A further object is to provide a recessed end opening in the dome shaped end wall of the, to receive a protuberance on the gripper, for frictional retention of that protuberance. An over center or retention interfit of the protuberance in that opening, allows endwise motion of the gripper in the body, to assist in loosening of the wound tube end from the gripper.

BRIEF DESCRIPTION OF THE DRAWINGS

These and other objects and advantages of the invention, as well as the details of an illustrative embodiment, will be more fully understood from the following specification and drawings, in which:

FIG. 1 is a perspective view of one embodiment of a device incorporating the invention;

FIG. 2 is a top view of the FIG. 1 device;

FIG. 3 is a section taken on lines 3-3 of FIG. 2;

FIG. 7 is a side view taken on lines 7-7 of FIG. 6, and showing inlet construction;

FIG. 8 is a view taken on lines 8-8 of FIG. 6;

FIG. 9 is a view taken on lines 9-9 of FIG. 8;

FIG. 17 is a view like FIG. 13 showing a modified gripper;

FIG. 18 is an enlarged end view taken on lines 18-18 of FIG. 17; and FIG. 19 is a view like FIG. 14 showing a modification.

DETAILED DESCRIPTION

Figure 4:
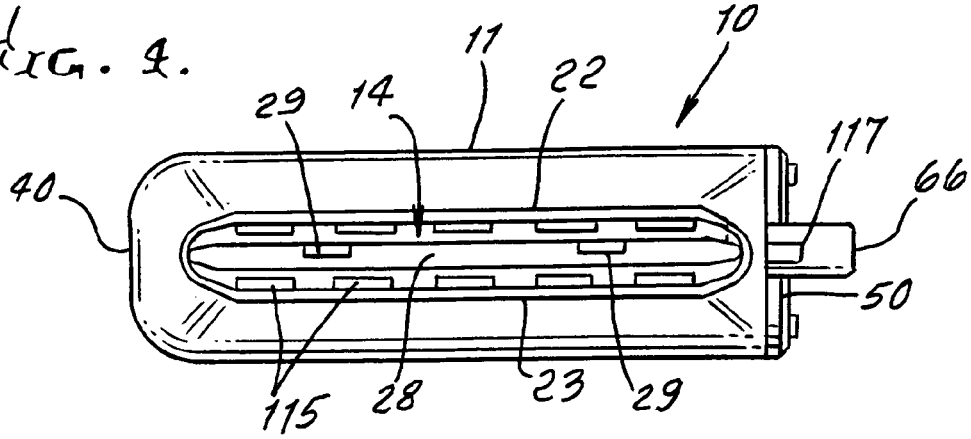
FIG. 4 is a view taken on lines 4-4 of FIG. 2.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Multiple embodiments are disclosed herein. FIGS. 1 through 19 describe aspects of a wind-up device that is preferably reusable, while the remaining figures illustrate embodiments of a permanent wind-up device assembly for attachment to a dispenser.

Figure 5:
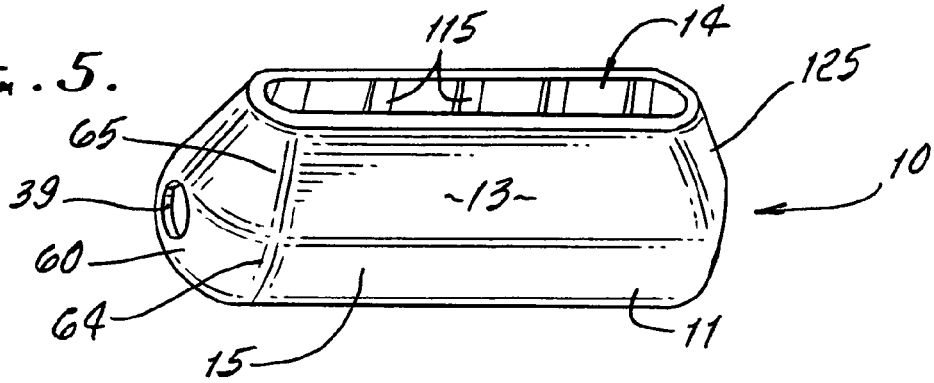
FIG. 5 is another perspective view, showing dual domed construction of the device of FIG. 1.
Figure 6:
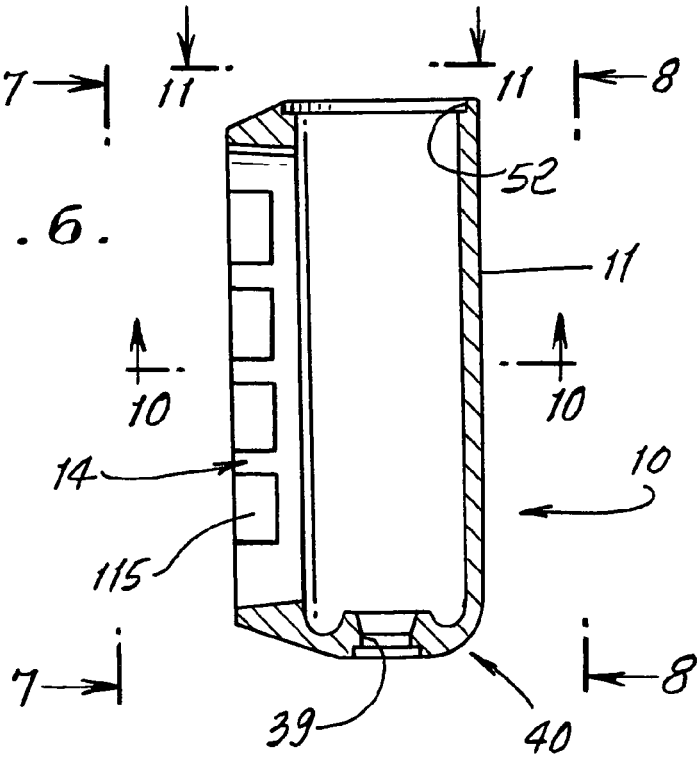
FIG. 6 is a side view of the FIG. 5 device, showing end and top walled domed construction, without the winder assembled to the domed body.
Figure 10:
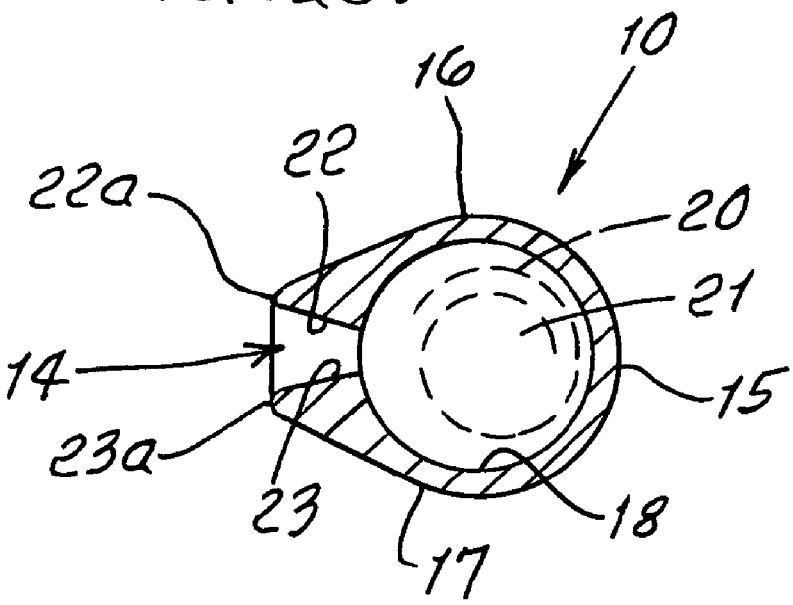
FIG. 10 is a cross section on lines 10-10 of FIG. 6.
Figure 11:
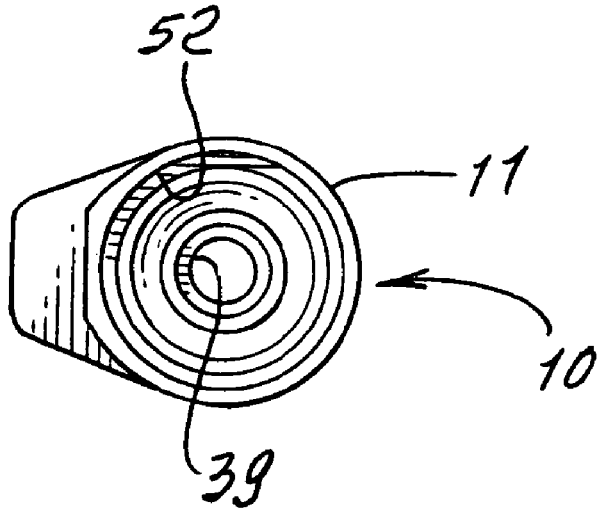
FIG. 11 is a plan view taken on lines 11-11 of FIG. 6.
Figure 12:
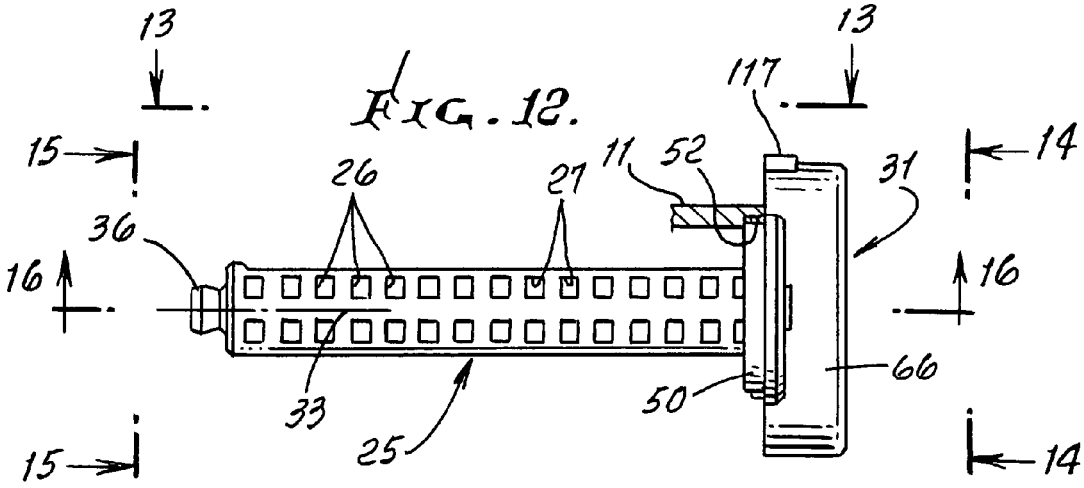
FIG. 12 is a side view of the gripper and winder taken on lines 12-12—of FIG. 11, and the knob end of which is also seen in FIGS. 1-4.
Figure 13:
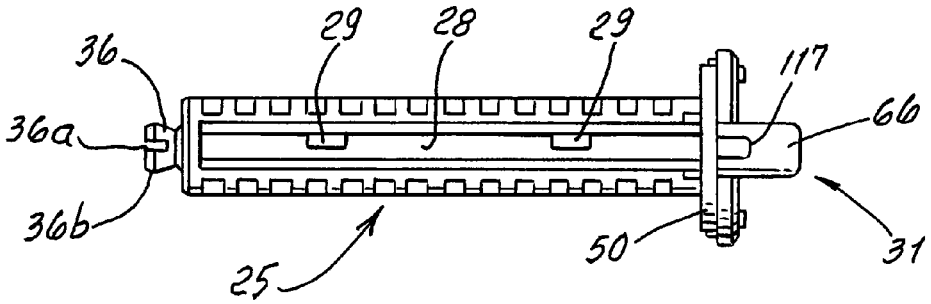
FIG. 13 is a side view taken on lines 13-13 of FIG. 12.
Figure 15:
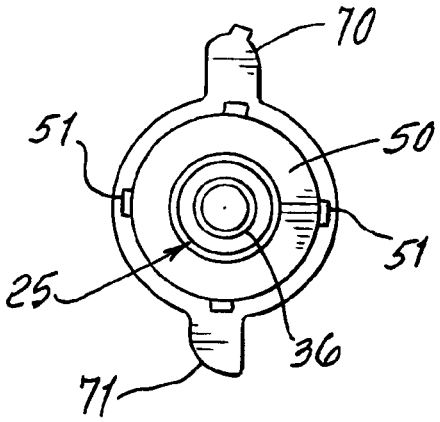
FIG. 15 is an end view taken on lines 15-15 of FIG. 12.
Figure 14:
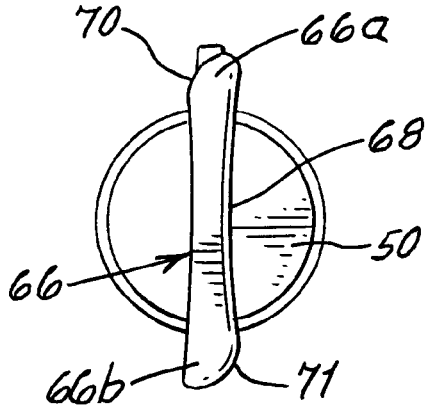
FIG. 14 is an end view taken on lines 14-14 of FIG. 12.
Figure 16:
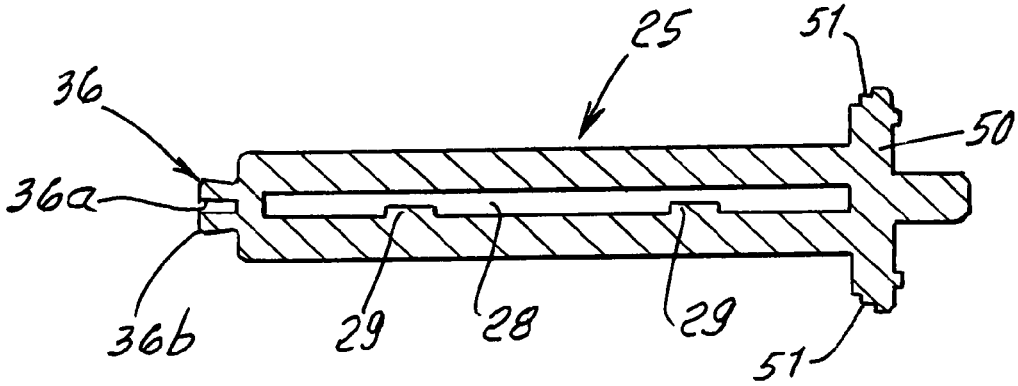
FIG. 16 is a sectional view taken on lines 16-16 of FIG. 12.

In the drawings of FIGS. 1 through 19, a squeezable dispenser (for example toothpaste tube or any type of tube) wind-up device is seen at 10 in FIGS. 1 and 5. It includes:

a) a longitudinally elongated hollow body 11 having opposite, substantially flat exterior sides 12 and 13, which may be alike, and which taper laterally toward a longitudinally elongated slot-like body inlet 14 at one lateral extremity of the body.

b) The body 11 has an outwardly enlarged, easily manually grippable first domed exterior surface 15 at the opposite lateral extremity of the body (i.e. opposite inlet 14). Surface 15 merges convexly with the opposite sides 12 and 13, at regions 16 and 17 seen in FIG. 10. Surface 15 may be a segment of a circle; and the body interior surface 18 (FIG. 10) may also be circular, for best reception and guiding of a deformable tube (such as a toothpaste tube) 20 spirally wound in interior 21 (FIG. 10).

c) The body inlet 14 is sized, and preferably has tapered inlet walls 22 and 23 (FIG. 10), to progressively receive and grip a deformable tube (for example and toothpaste tube) closed end portion 220 (FIG. 1) fed progressively into the body interior 21, to be wound; and a longitudinally elongated tube gripper 25 is extended longitudinally in the body interior to grip the tube closed end portion, for rotation and progressive wind-up above the gripper 25. The gripper 25 as seen in FIGS. 12, 13 and 16 may be substantially cylindrical, and have multiple edges 26 as formed by radial slots 27 in the gripper walls and spaced along its length, to enhance guided gripping of the tube. An elongated slot 28 in the gripper receives the closed end of the tube inserted via the inlet. The teeth 29 project into the slot 28 to positively grip the deformable tube end portion at a location spaced about equal distances from the ends of the slot. Such teeth can be any size or shape, or such teeth can be omitted.

d) In addition, a winder 31 is provided at one end of the body, and is operatively connected with the gripper 25, for rotating the gripper about longitudinal axis 33 for winding the tube closed end, inserted into slot 28, as well as the flattened end of the tube, about the gripper. Note that the gripper 25 has a protruding bearing 36 (FIGS. 12, 13) at its end, for reception into an opening 39 in secondarily domed end 40 of the body 11, to form a bearing for gripper rotation. The opening 39 and bearing 36 may have over-center interfit, for forcibly retaining the gripper 25 in axial position, but with clearances as at 39*a* (FIG. 3) allowing some endwise play of the gripper 25, as during unwinding removal of the wound tube from the gripper, helping freeing of the tube end from the gripper. FIGS. 3 and 16 also show that bearing 36 may have a slot 36*a* enabling squeezing together of bearing portions 36*b* to release the bearing 36 from engagement with the bore of body annulus 11*c*, which acts as a frictional retainer. The winder can then be removed endwise. A second bearing is formed by a disc 50 (FIG. 12) at the opposite end of the gripper, having small protrusions 51 (FIG. 15) bearing frictionally against the shallow bore 52 (FIG. 6) in the body to position the gripper and disc axially. See FIGS. 6 and 12. Bearing 36 held in opening 39 retains disc 50 in axial position, yet enables axial displacement of the gripper relative to the body, for assisting in dislodging the tube end from the gripper. In use, the end of the tube may be initially squeezed to provide a tube end portion to be inserted through the entrance slot, and into the winder. The device is then held by one hand, and the winder knob is rotated manually, by the user's other hand. The tube is wound up until the filled portion of the tube engages the body entrance slot. The tube contents are then dispensed, and the user winds the tube as needed. When the tube is empty, the knob is turned reversely to unwind the tube, to enable its withdrawal from the device. A new tube is then applied to the device. The opposite end of the body 11 has an endwise secondarily domed outer surface 60 (FIG. 5) for smooth comfortable nesting in the palm of the hand of the user. Domed surface 60 convexly merges in dual relation with both the first dome surface 15, and with the flat opposite sides 12 and 13. See FIG. 5 and convex merger locations 64 and 65.

It will also be seen that the winder 31 includes an externally protruding, transversely elongated knob 66, and a carrier for the knob, as represented by disc 50, extending in a plane normal to the axis of rotation defined by the winder. The knob 66 is outstanding from the disc 50, and extends parallel to the disc. It has opposite ends 66*a* and 66*b* (FIG. 14) that typically extend transversely beyond the disc periphery, for ready manual gripping. The knob may have a shallow venturi shaped (outwardly concave) mid-portion 68, of reduced width, relative to the widths of the knob opposite ends, for smoothly engaging manual finger and thumb convex surfaces that grip the knob. Opposite ends of the transverse knob may be beveled at opposite sides 70 and 71, seen in FIGS. 14 and 15, for ease of knob rotation, as resisted by the requirement for metallic tube deformation, about the winder.

The body also has a tapered shoulder 125 (FIG. 5) extending from a location proximate the carrier to a location proximate and end of the inlet. That convex shoulder extends toward the path of rotation of one end of the winder.

Additional features which may be included are as follow: In FIG. 10, the body walls 22 and 23 may be rounded at 22*a* and 23*a* to smooth the tube engagement with the walls, at the inlet 14. Also grooves 115 (FIG. 5) in walls 22 and 23 assist in feeding or guiding of the tube into the inlet. Guide or gripper teeth 29 (FIG. 4) may also be provided on the winder or reel, as referred to above, and as seen in FIGS. 12 and 13. Such teeth and guide grooves may be omitted. Surface regions 16 and 17 of the body taper toward the inlet 14 side of the body, as seen in FIG. 10, and may provide regions for application of indicia, such as lettering.

FIG. 1 shows an indicator 117 on the knob, positioned relative to an element body 11 to indicate when the 28 slot in the winder is aligned with inlet 14, to accept entrance into the slot of the tube end.

Referring to FIG. 17, which shows a modified gripper 200 that is similar to the gripper 25 of FIG. 13. However, there are no teeth in the modified gripper 200 at the slot region 201 that receives the tube end. FIG. 18 shows a re-usable braking device at 202 that is part of a re-usable knob 204 on the gripper, and characterized as enabling rotation of the gripper in opposite directions, in the body. FIGS. 17 and 19 show a re-usable knob 204 on the gripper, with a venturi shaped, elongated turning handle 205.

Figure 20:
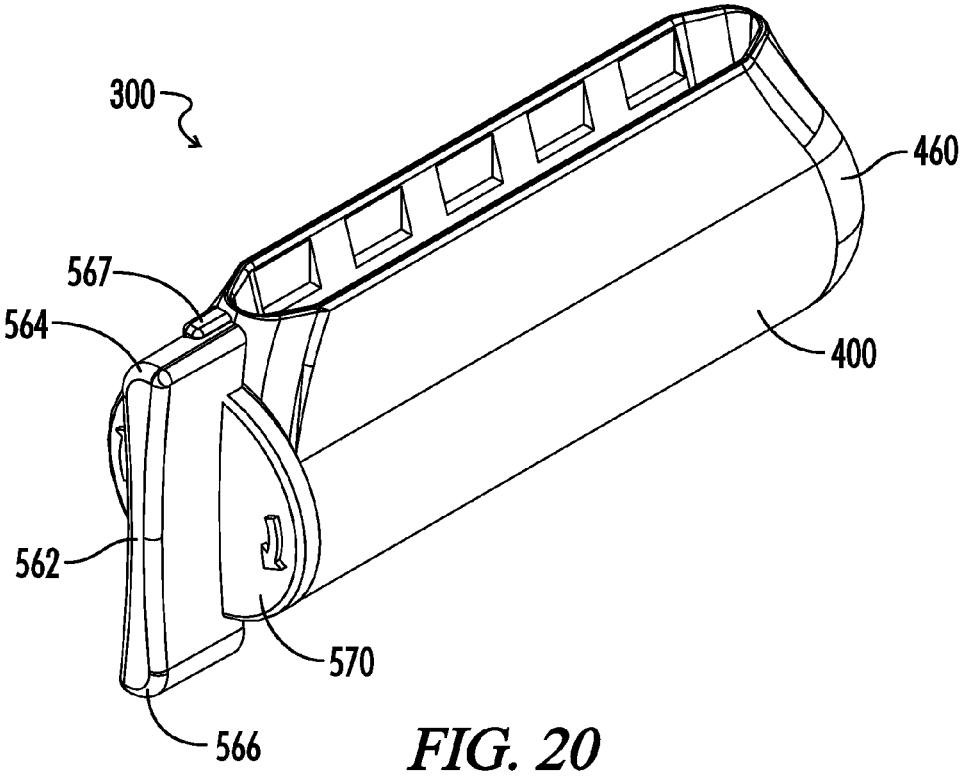
FIG. 20 is a perspective view like of one embodiment of a device incorporating aspects of the present invention.
Figure 21:
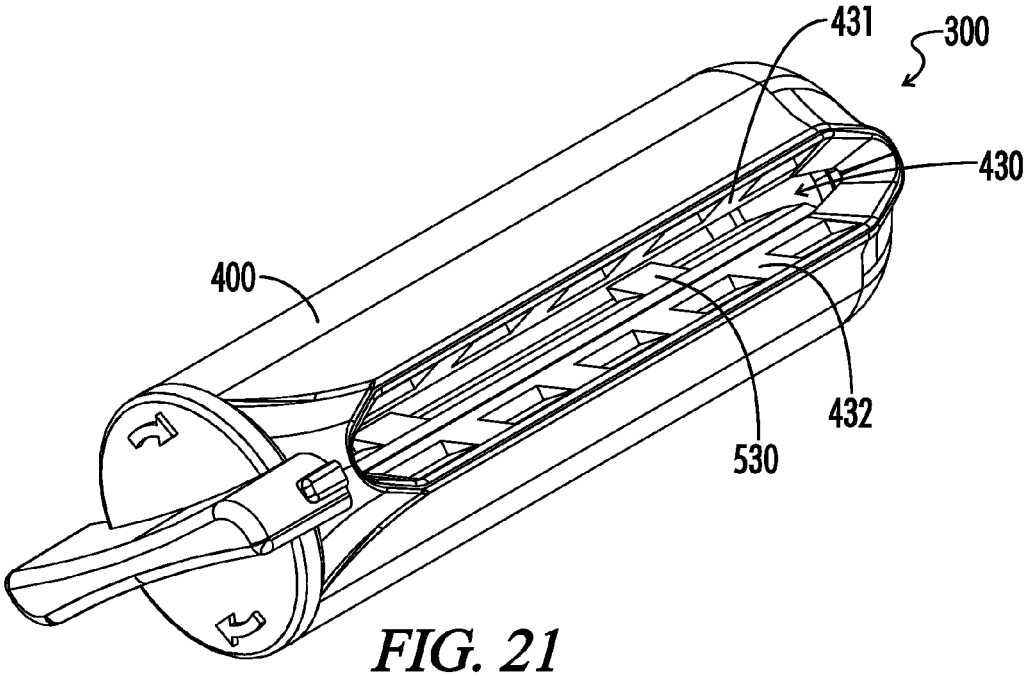
FIG. 21 is a rotated view of the device of FIG. 20.
Figure 22:
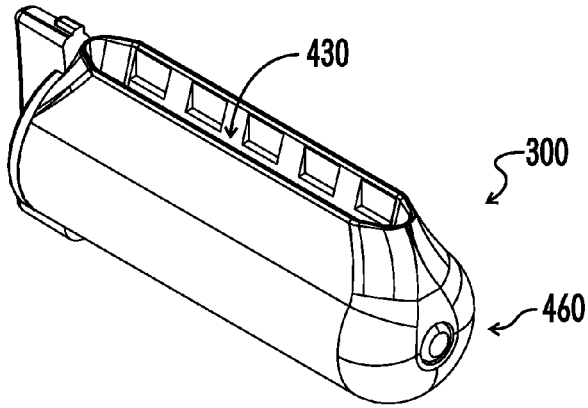
FIG. 22 is another perspective view of the device of FIG. 20.
Figure 23:
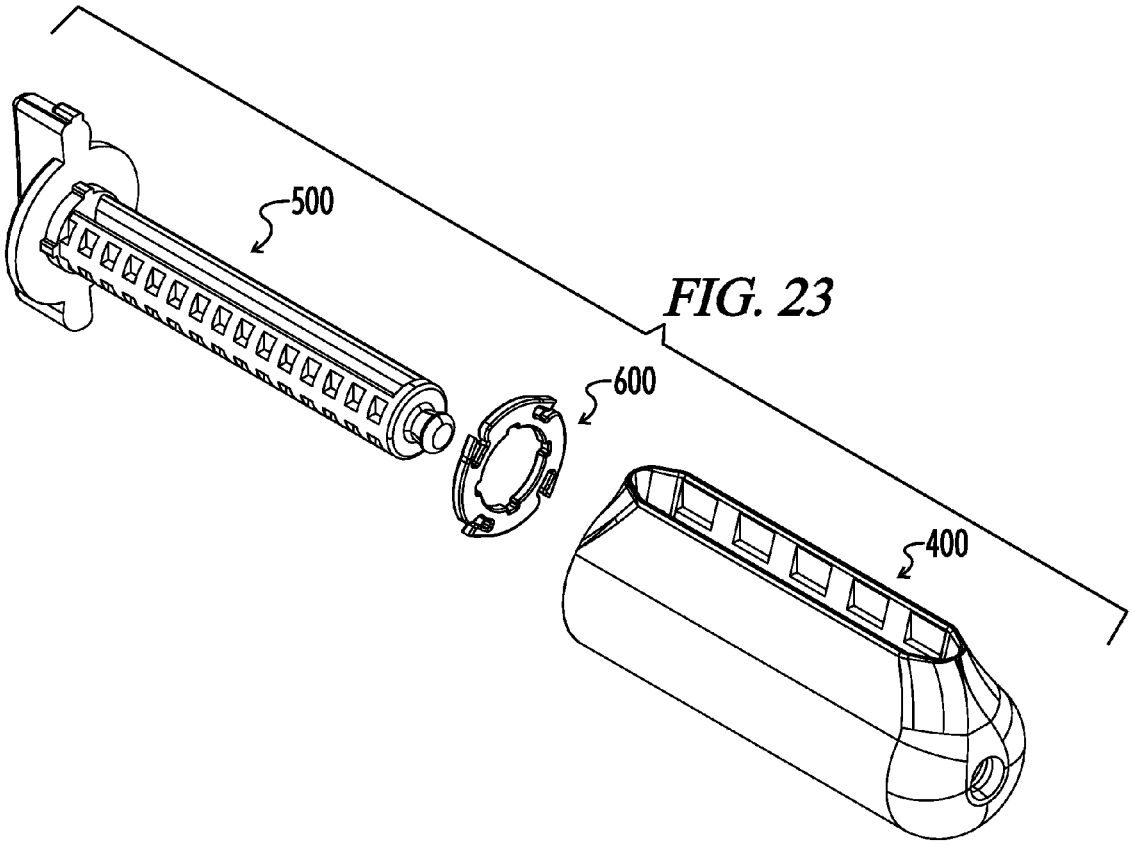
FIG. 23 is an exploded view of the device of FIG. 22.
Figure 24:
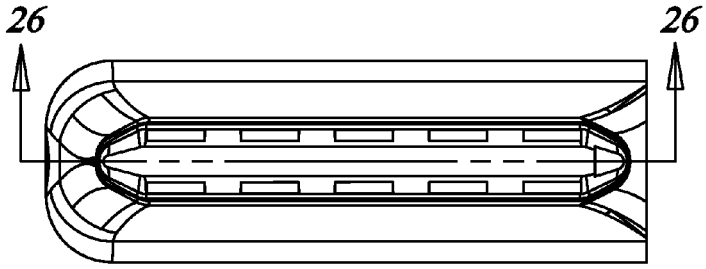
FIG. 24 illustrates one embodiment of a body of the device of FIG. 20 looking into the inlet of the body.
Figure 25:
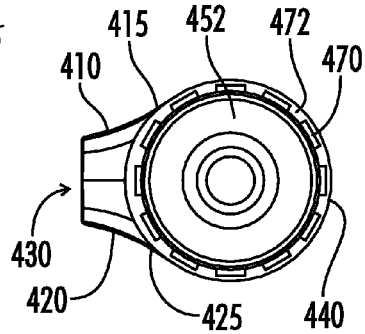
FIG. 25 is a right side view of the body of FIG. 24.
Figure 26:
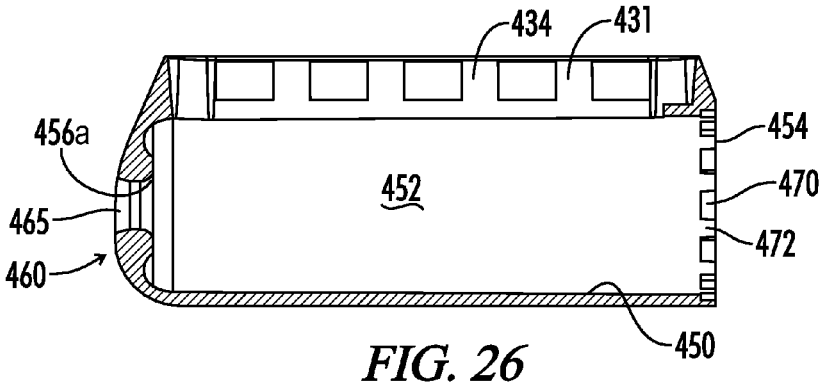
FIG. 26 is a cross-section taken along line 26-26 of FIG. 24.
Figure 27:
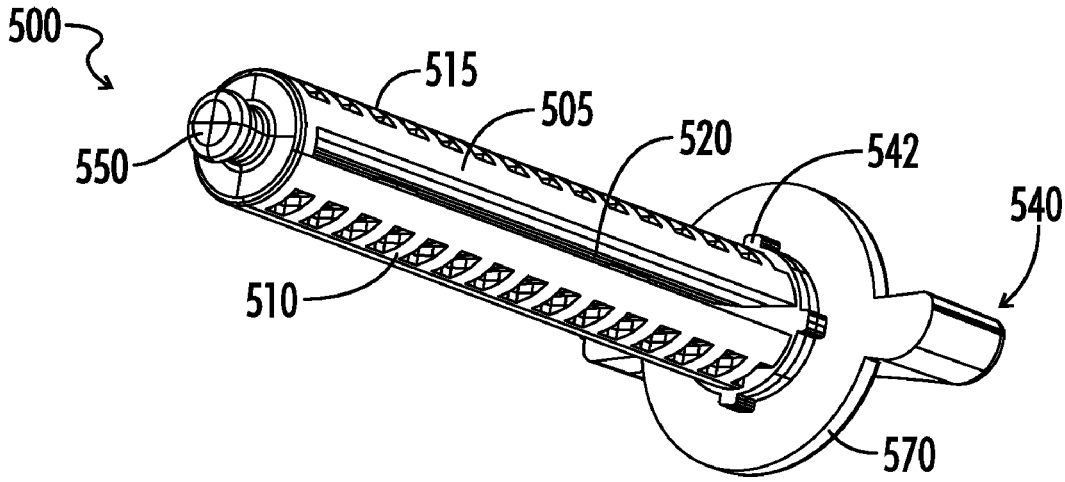
FIG. 27 illustrates one embodiment of a gripper of the invention.
Figure 28:
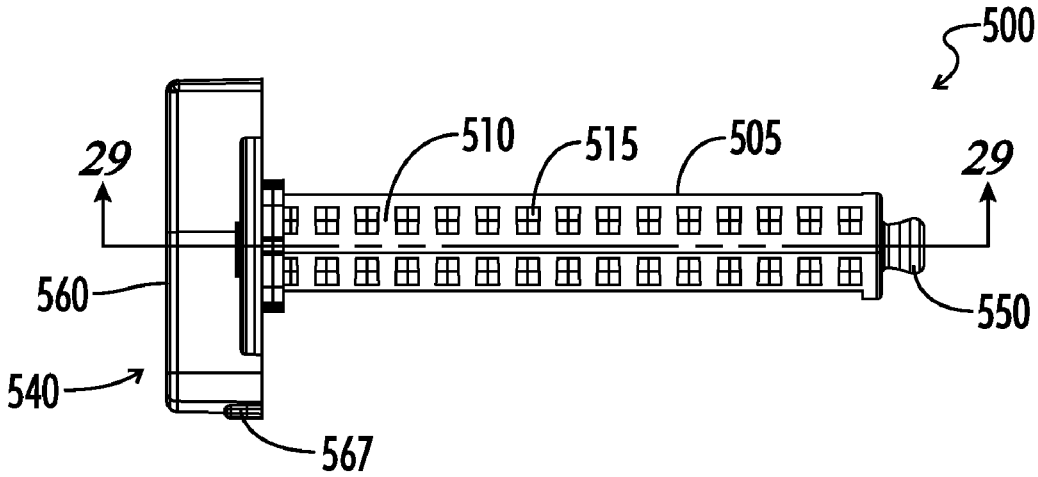
FIG. 28 is a side elevation view of the gripper of FIG. 27.
Figure 29:
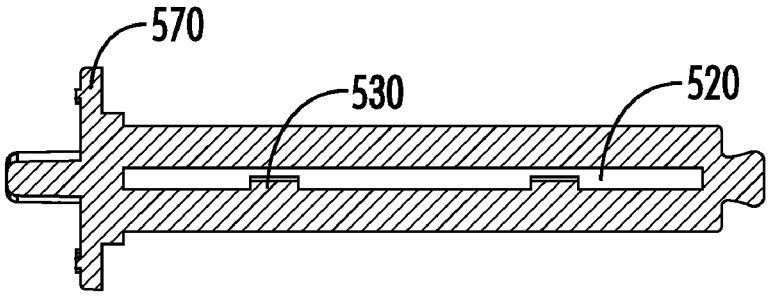
FIG. 29 is a cross-section taken along line 29-29 of FIG. 28.
Figure 30:
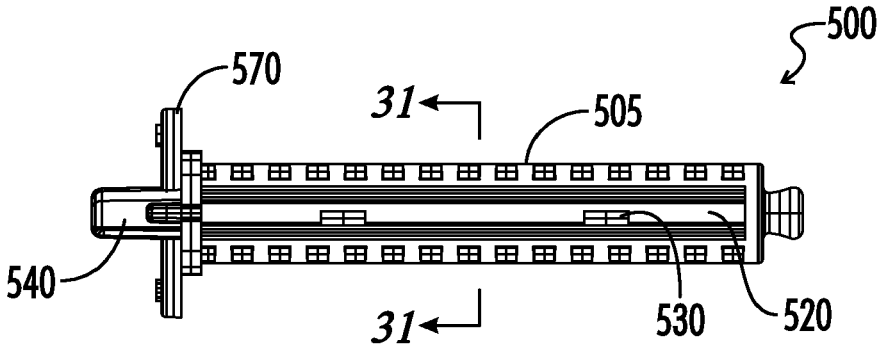
FIG. 30 is a top view of the gripper of FIG. 27.
Figure 31:
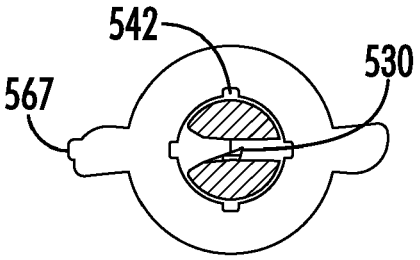
FIG. 31 is a cross-section taken along line 31-31 of FIG. 30.
Figure 32:
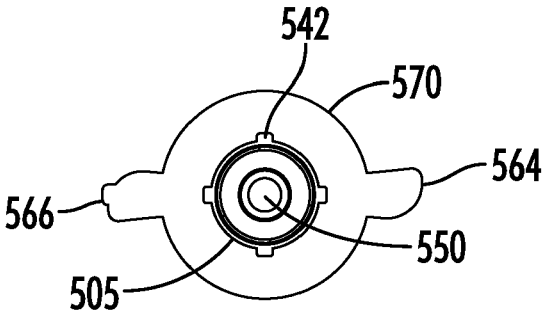
FIG. 32 is an end view of the gripper of FIG. 29.

FIGS. 20 through 23 illustrate perspective views and an exploded view of an alternative embodiment of a wind-up device 300 having a body 400 and a winding gripper 500, the body 400 shown in FIGS. 23 through 25 and the gripper 500 shown in FIGS. 26 through 32. For the most part, the device 300 of FIG. 20 is similar in structure to the device 10 of FIG. 1. However, while the device 10 of FIG. 1 is intended for reusable application with multiple tubes, the device 300 is intended to be more permanent in nature, where the tube is preferably not removable relative to the device 300 once the tube is attached, or where the device 300 is provided with a tube already attached thereto. This is achieved through the use of a braking device 600 (hereinafter "brake 600") shown separately in FIGS. 33 through 36 that is attached between the body 400 and the gripper 500 and that preferably fixes or locks the position of the gripper 500 relative to the body 400 at intervals of rotation, helps ensure that the gripper 500 is rotated in only one direction relative to the body 400, and prevents the gripper 500 from undesirably spinning freely or unwinding once a deformable tube is attached thereto. The body 400, gripper 500 and brake 600 will now be described.

As shown in the embodiment FIGS. 21 and FIGS. 24 through 26, the body 400 has opposite, substantially flat exterior sides 410 and 420 (numbered in FIG. 25), which may be alike, and which taper laterally toward a longitudinally elongated slot-like body inlet 430 at one lateral extremity of the body 400. While the body 400 is shown and described with a particular rounded shape, thickness and the like, other shapes, sizes, thicknesses and configurations are possible, such as, but not limited to square, triangular or other configurations. The inlet 430 is preferably rounded (FIG. 24) so as to not damage a tube during insertion through the inlet 430, and the inlet 430 preferably has tapered inlet walls 431, 432 (FIG. 21) and grooves 434 (FIG. 26) to assist with the feeding or guiding of a tube (not shown) as will be described below. The body 400 has an outwardly enlarged, easily manually grippable first domed exterior surface 440 at the opposite lateral extremity of the body opposite inlet 430. Surface 440 may be adorned with logos, graphics, instructional messages, etc., which may be printed on, engraved or otherwise provided thereon. Other aesthetical provisions are contemplated. Surface 440 merges convexly with the opposite sides 410 and 420, at regions 415 and 425 seen in FIG. 25. Surface 440 may be a segment of a circle, and the body interior surface 450 may also be circular, for best reception and guiding of a deformable tube (such as a toothpaste tube or any tube; not shown) spirally wound in interior 452 as will be described below. The first domed exterior surface 440 convexly merges in dual relation with an endwise second domed outer surface 460, and with sides 410 and 420, for smooth comfortable nesting in the palm of the hand of the user. The body 400 is also provided with a circumferential arrangement of spaced-apart notches 470 and steps 472 formed into the thickness (FIG. 25) of the body 400 and provided along the open end 454 of the interior surface 450 that engage with the braking device 600 as will be discussed below.

As shown in FIGS. 27 through 32, the winding gripper 500 further comprises a body 505 that may be substantially cylindrical, and have multiple edges 510 as formed by radial slots 515 in the gripper walls and spaced along its length, to enhance guided gripping and winding of a tube thereabout. An elongated slot 520 in the gripper body 505 receives the closed end of a tube inserted via the inlet 430 of the body 400. Teeth 530 preferably project into the slot 520, to positively grip the deformable tube end portion as described below, although such teeth 530 may be replaced with some other type of gripping or retaining means as desired that is also effective to retain a deformable tube portion inserted into the inlet 430. A winder 540 is provided at one end of the gripper body 505 for rotating the gripper 500 about its longitudinal axis for winding a tube that has been inserted into slot 520, as well as the flattened end of the tube, about the gripper body 505. A protruding bearing 550 is provided at an end of the gripper body 505 opposite the winder 540 for reception into an opening 465 (FIGS. 26 and 38) in secondarily domed outer surface 460 of the body 400, to form a bearing for gripper rotation. While a single winder is shown on one side of the gripper body 505, in an alternative embodiment another winder (not shown) may be provided on the opposite end of the gripper body 505 if desired. While a circular bearing 550 is shown, other shapes, configurations or structures are possible. The opening 465 and bearing 550 may have over-center interfit for forcibly retaining the gripper 500 in axial position, but with clearances 465*a* (FIG. 26) allowing some endwise play of the gripper 500 relative to the body 400. Unlike the gripper 25 of FIG. 13, for example, the bearing 550 on the gripper 500 is not provided with a slot to assist in the release of the bearing 550 from the opening 465 because in the disclosed embodiment the gripper 500 is preferably attached to the body 400 so as to not be removable therefrom.

The winder 540 further preferably comprises an externally protruding, transversely elongated knob 560 associated with a carrier 570 for the knob 560 that extends in a plane normal to the axis of rotation of the winder 540, and that may be provided with arrows (FIGS. 20 and 21) or the like to indicate the direction of rotation. The knob 560 may have a shallow venturi shaped (outwardly concave) mid-portion 562, of reduced width, relative to the widths of the knob opposite ends 564, 566 (which may be beveled if desired) for smoothly engaging manual finger and thumb convex surfaces that grip the knob (FIG. 20). In a multi-winder embodiment (not shown), a knob may be provided on either side of the gripper body 505 for multi-finger operation. An indicator 567 (FIGS. 20 and 28) may be provided on the knob 560 that is positioned relative to the body 400 to indicate when the slot 520 in the gripper 500 is aligned with inlet 430 to accept entrance of a tube into the slot 520. Alignment members 542 are provided at the intersection of the gripper body 505 and carrier 570 for receiving alignment notches 610 defined along an interior circumference 620 in the brake 600 (FIGS. 33 through 37B) for aligning the brake 600 relative to the gripper 500 as shown in FIGS. 23 and 38. The brake 600 can be snapped in place permanently or can be removable.

Figure 37A:
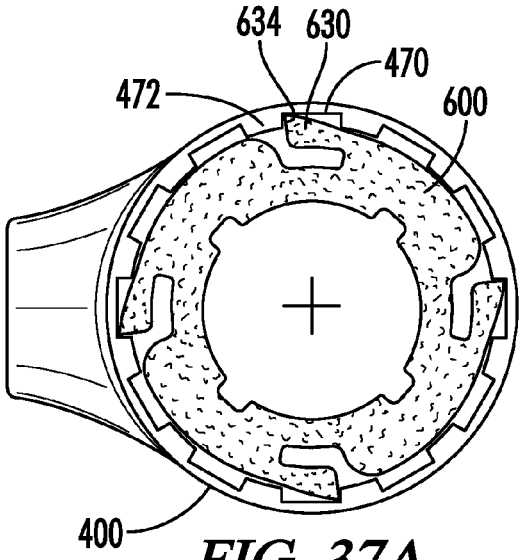
FIG. 37A illustrates one embodiment of the fingers of a braking device engaged with notches in the body of a device.
Figure 37B:
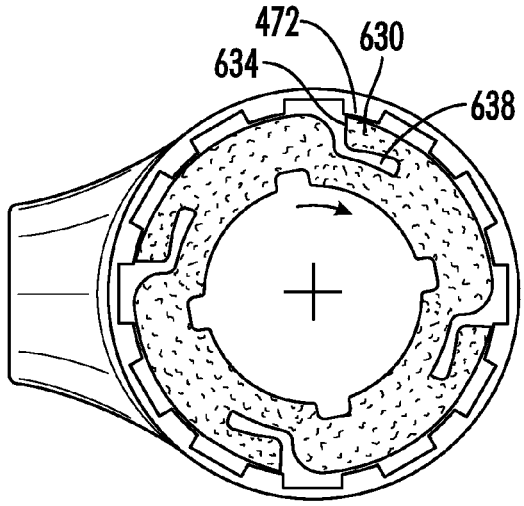
FIG. 37B illustrates the rotation of the braking device within the body of FIG. 37A.
Figure 38:
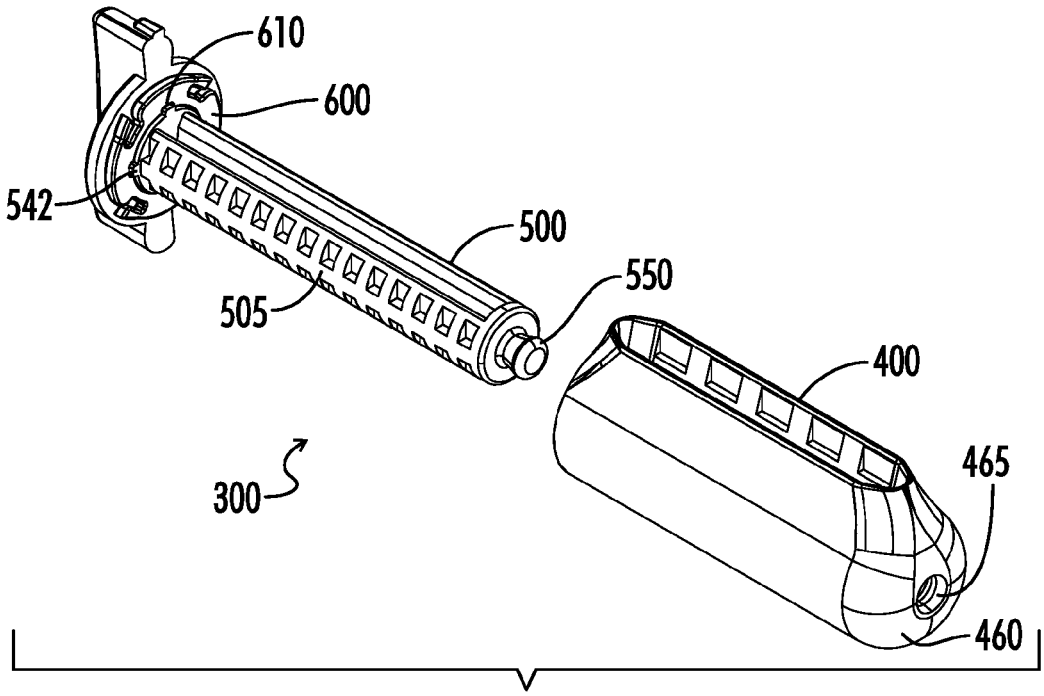
FIG. 38 illustrates one embodiment of an assembly of a gripper and braking device with a body of a device.

As shown in FIGS. 33 through 37B, the brake 600 is preferably in the form of a substantially flat, ring-shaped disk that is also provided with a plurality of fingers 630 around an exterior circumference 640 that is substantially defined at a first radius 642 relative to a central axis 644 of the brake 600. While four fingers 630 are shown with a particular configuration, other numbers of fingers, configurations, sizes, shapes and thicknesses are possible. Each finger 630 has a cam surface 632 that angles outwardly from the exterior circumference 640 at a transition point 631 and terminates at a free end surface 634 that extends downwardly toward the central axis 644, which free end surface 634 transitions into an interior surface 636 that is defined around an opening 638 that allows the finger 630 to deflect downward in response to a downward pressure applied to the cam surface 632. When the brake 600 is seated relative to the notches 470 and steps 472 provided along the open end 454 of the interior surface 450 of the body 400, the fingers 630 will deflect downward into the openings 638 when the cam surfaces 632 of the fingers 630 impact edges of the steps 472 and are then aligned with the steps 472 (FIG. 37B), whereby the fingers 630 assume a tangential relationship to the exterior circumference 640, and the fingers 630 will bias upwardly when aligned with the notches 470 (FIG. 37A). When the brake 600 is rotated and the fingers 630 are aligned with the notches 470, the finger 630 biases upwardly into the notch 470 and the free end surface 634 engages with the side surfaces of the notch to prevent the finger 630 from rotating in the opposite direction (FIG. 37A). In other words, the engagement of the flat free end surface 634 with the notch side wall acts as a stop or a brake, thereby allowing the brake 600, and therefore winding gripper 500, to rotate in only one direction relative to the body 400 and thereby prevent any counter rotation or unwinding. However, rotation of the brake 600 in the opposite direction is facilitated through the impact of the cam surface 632 against the opposite side wall of the notch 470, which causes the finger 630 to deflect downward and become released from the notch 470 (FIG. 37B). The number of rotation intervals is dependent on the number of fingers 630 and the number of notches 470, with each being variable and adjustable at the time of manufacture. In the illustrated embodiment, the fingers 630 are arranged at ninety degree intervals around the outer circumference 640, although other intervals are possible.

Figure 33:
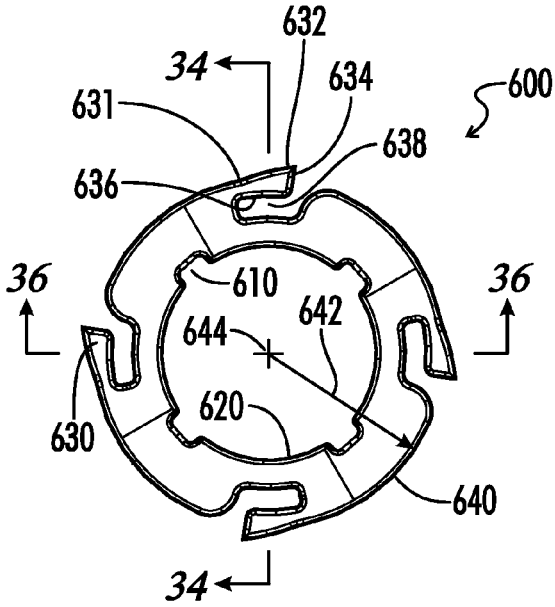
FIG. 33 is a front view of one embodiment of a braking device incorporating aspects of the present invention.
Figure 34:
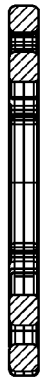
FIG. 34 is a cross-section taken along line 34-34 of FIG. 33.
Figure 35:
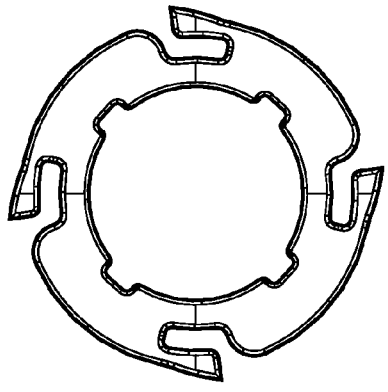
FIG. 35 is a rear view of the braking device of FIG. 33.
Figure 36:
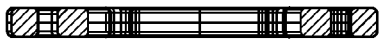
FIG. 36 is a cross-section taken along line 36-36 of FIG. 33.

Rotation of the brake 600 in the clockwise direction is achieved when the fingers 630 are pointing or directed in the counter-clockwise direction as shown in FIG. 35, while rotation of the brake 600 in the counter-clockwise direction is achieved when the fingers 630 are pointing or directed in the clockwise direction as shown in FIG. 33. The positioning of the brake 600 relative to the alignment members 542 on the gripper 500 (FIG. 38) will determine whether the gripper 500 will be rotatable clockwise or counter-clockwise relative to the body 400. It is preferable for the gripper 500 to be rotatable clockwise as is the convention for advancing or tightening objects, such as with screws and the like. However, the alignment notches 610 on the brake 600 are designed such that the brake 600 may be seated on the alignment members 542 to be rotatable in either direction, with the fingers 630 pointing in a clockwise or counter-clockwise direction. In the illustrated embodiment, four alignment notches 610 are arranged at ninety degree intervals around the inner circumference 620, although number of notches and/or other intervals are possible. However, while not shown, the alignment notches 610 and the corresponding alignment members 542 could be arranged so that the brake 600 seats in only one orientation relative to the gripper 500, which would ensure that the gripper 500 is only rotatable in one direction at all times. The notches 470 and steps 472 in the body 400 can be any size, shape or configuration, and the number of notches 470 and steps can be varied as well within a 360 degree rotation. Of course, the fingers 630 would need to be sized and shaped appropriately to mate with the notches as described above. In addition, in the embodiments described herein, the brake is preferably separate from the gripper or body. However, the brake could be integral with the gripper as a single piece, permanent attachment or not or the brake could be integral with the body and the gripper could be provided with notches, etc., that mate with fingers on the brake in an opposite orientation to the shown and described herein.

Figure 39:
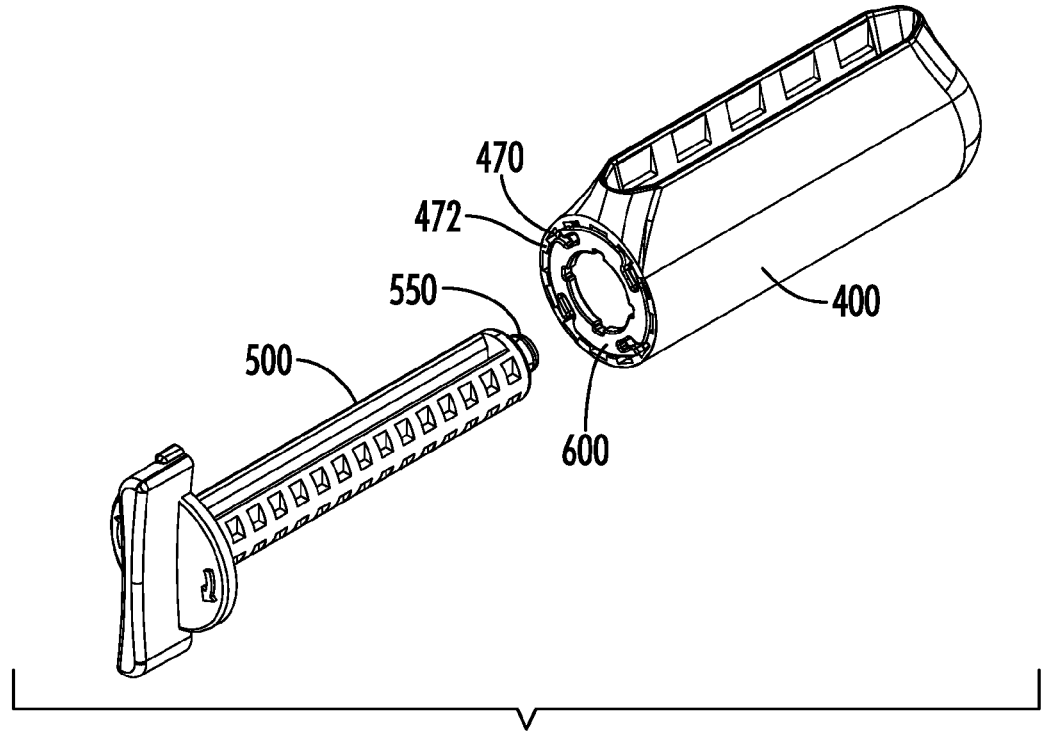
FIG. 39 illustrates one embodiment of an assembly of a gripper with a braking device and body.

FIG. 38 illustrates an assembly of one embodiment of the device 300, where the brake 600 is slid onto the gripper body 505 of the gripper 500 and the alignment notches 610 on the brake are brought into alignment with the alignment members 542 on the gripper 500. The gripper body 505 is then inserted into the body 400 and the bearing 550 is aligned with and inserted into the opening 465 in the body 400 (see FIG. 22), at which time the brake 600 engages the open end 454 of the body 400 and the fingers 630 engage the notches 470 and/or steps 472 depending on the rotation of the gripper 500 and brake 600 relative to the body 400 (FIG. 39). An inner surface of the opening 465 is preferably of a reduced diameter so that passage of the bearing 550 through such reduced diameter section results in the bearing 550 being retained in the opening 465. This allows the gripper 500 and housing 400 to form a single unit and allows the gripper 500 to turn easily.

Figure 40:
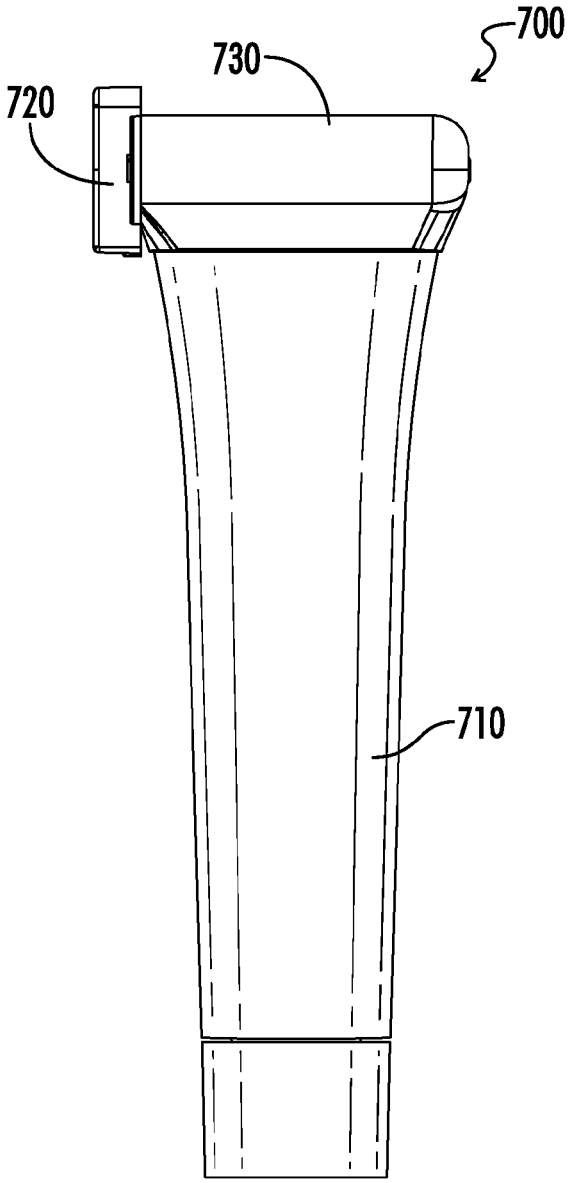
FIG. 40 illustrates one embodiment of a wind-up device engaged with a dispenser tube making it one unit.

FIGS. 40 through 50 show several examples of embodiments of a wind-up device being used in connection with various deformable tubes. FIG. 40 shows an alternative embodiment of a wind-up device 700 that is integral with a squeezable dispenser tube 710 that is designed to make the tube 710 look like it belongs on the wind-up device 700 permanently. It may have ergonomic feel and style, making it feel more comfortable to hold and use. To use, the user squeezes the tube like they normally would and when needed the user turns the knob 720 on the wind-up device 700, usually the user holds the body 730 with one hand and turns the knob 720 with the other hand to roll-up the used portion of the tube until the tube is full. Then the user would repeat this process. So, when the user has 50% contents left in the tube, the tube will still remain full when they squeeze it. When the user has 20% left in the tube, the tube will remain full and so on. Having the device of the present disclosure allows the user to have the feeling of squeezing a brand new tube every time all the way until it's empty. The design is made to look like the tube 710 continues onto the wind-up device 700. The shape of the wind-up device 700 can be any shape or design or size, and can be, for example, designed with characters or logos on it. The wind-up device 700 can have a built-in hang tab (not shown) so the tube 710 can be hung on peg hooks (not shown) for example.

Figure 41:
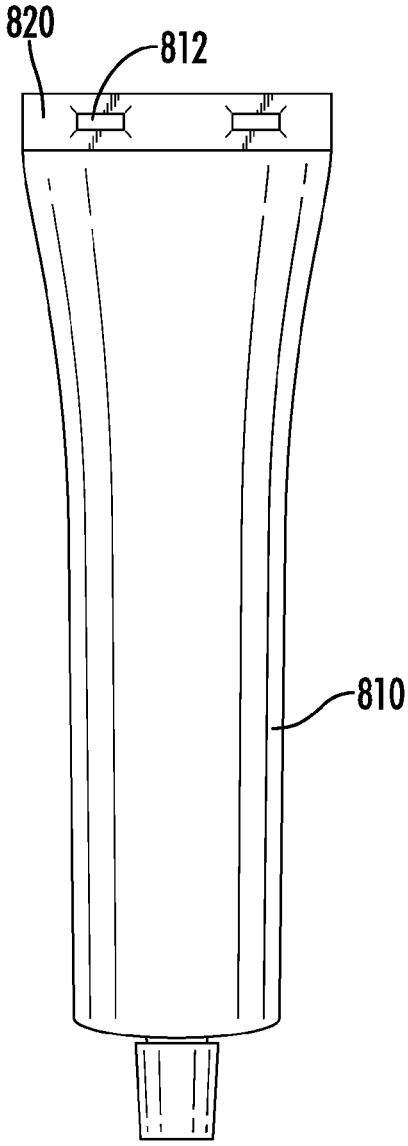
FIG. 41 illustrates one embodiment of a dispenser tube having crimped end openings that is engageable with a wind-up device.
Figure 42:
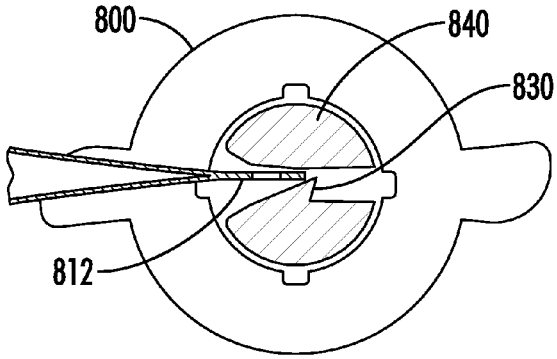
FIG. 42 illustrates one embodiment of a cross-sectional view of the tube of FIG. 41 engaging with the wind-up device.
Figure 43:
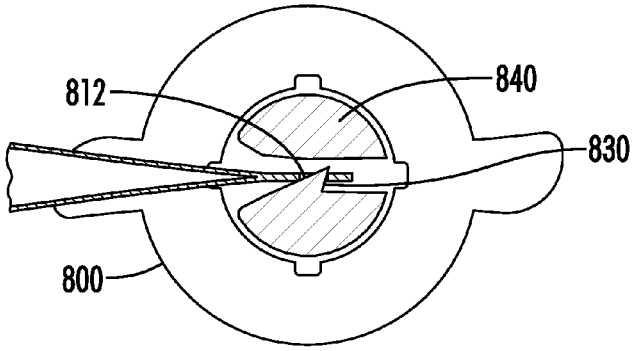
FIG. 43 illustrates the engagement of the tube of FIG. 41 with the wind-up device.

FIG. 41 illustrates an embodiment of a deformable tube 810 with holes 812 in the crimped end 820 of the tube 810. The holes 812 may be, for example, rectangular shaped, approximately the size of and in alignment with the teeth or catches 830 inside the gripper 840 (FIGS. 42 and 43), and such holes 812 may be reinforced if desired to increase their strength. Other hole shapes, numbers, sizes and configurations are possible as long as the teeth or catches 830 are appropriately mating. The holes 812 serve as a catch mechanism in combination with the teeth 830 to connect the tube 810 with the embodiment of the wind-up device 800 as shown in FIGS. 42 and 43. Such teeth or catches 830 are provided to preferably permanently connect the tube 810 with the device 800. There can be one to any number of catches or connectors 830 or any size and shape. The gap distance from the end of the catch point to the other reel interior slot surface is preferably a little bigger than the thickness of the crimped end of the tube. This provides clearance beyond the catch point and allows the tube hole on the crimped end to be inserted past the catch point and then the tube hole or catch point goes over the angled point and once over this catch point, the tube crimped hole goes past and fits over this angled catch point. One section of the crimped end hole is on the one side of the angled catch and the other end of the crimped end hole surface is over the angled catch. The part of the crimped tube hole surface closest to the end of the tube on the crimped end is resting against the flat section of the reel catch. The flat section of the catch prevents the tube from being pulled back out of the slot and the dispenser. Once the tube crimped end goes over the hill of the catch point and makes it over the tip of the catch point, then the reel catch latches onto the tube hole on the crimped end.

One method of manufacturing the tube 810 and device 800 is as follows. After the tube 810 is filled with material, the end is crimped or sealed 820 and then the end goes to another section that punches holes 812 in the crimped end 820 of the tube 810. These holes 812 usually are used to hang the tube 810 from peg hooks on store shelves, for example. However, when assembling the tube 810 to the device 800, the crimped end 820 is inserted into the slot of the gripper of the device 800 until the holes 812 mate with the teeth or catches 830, which could be accomplished with a machine or by hand. Thereafter, for extra security and to make the connection between the tube 810 and device 800 even stronger and to prevent the tube 810 from separating from the device 800, the knob on the device 800 could be rotated so the tube 810 partially winds up around the gripper reel. This process provides multiple layers of protection, namely the tube will be held by the gripper teeth or catches, the tube will be wrapped up around the gripper reel and will help prevent it from coming off, and the braking device will hold the gripper reel and knob in the same position. These three items will help the tube stay on the device and facilitate a permanent attachment. This above process can be automated for a fast and easy way of filling tubes and attaching them to wind-up devices.

Figure 44:
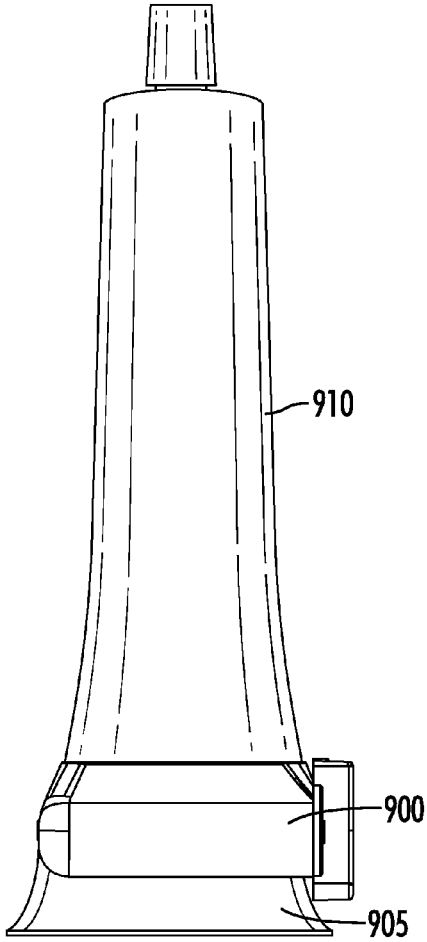
FIG. 44 illustrates one embodiment of a dispenser tube attached to a wind-up device that includes a stand.

FIG. 44 illustrates an embodiment of a wind-up device 900 with a built-in stand 905, so the wind-up device 900 and tube 910 can be set on a support surface. The use of a stand 905 could avoid the need for packaging, thereby preventing waste and saving the environment. The stand 905 can be permanent or removable and can be any shape or design that is known or hereinafter developed.

Figure 45:
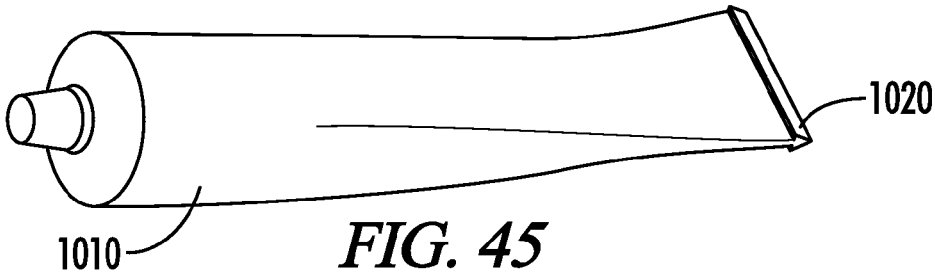
FIG. 45 illustrates one embodiment of a dispenser tube having crimped end that is engageable with a wind-up device.
Figure 46:
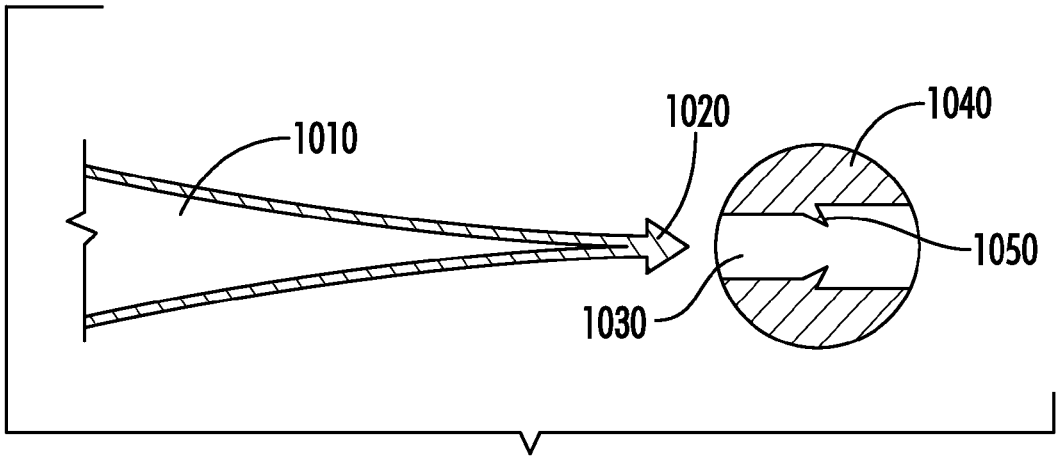
FIG. 46 illustrates one embodiment of a cross-sectional view of the tube of FIG. 45 engaging with a gripper slot of a wind-up device.
Figure 47:
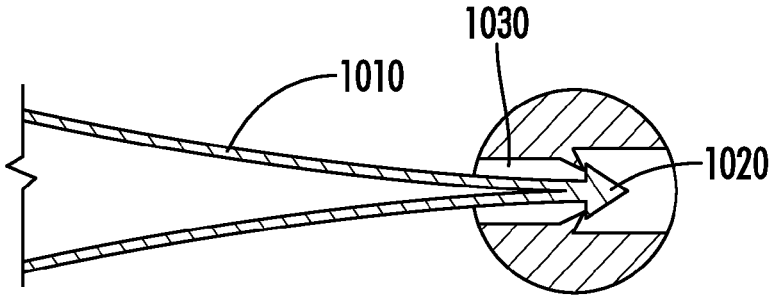
FIG. 47 illustrates the engagement of the tube of FIG. 45 with the gripper slot.

FIG. 45 through 47 illustrate the insertion of a deformable tube 1010 with a crimped end 1020 that might be, for example, arrow shaped, into the slot 1030 of a gripper 1040 in a wind-up device, where the slot 1030 is provided with teeth 1050 that engage the crimped end 1020 and prevent the crimped end 1020 from being withdrawn from the slot 1030. The crimped end 1020 can have a shape of other than an arrow, and it can also be dipped in plastic if desired to increase the strength. These teeth 1050 can have an angled surface and a flat surface or any type of surface. Once the crimped end 1020 advances past the angled part of the teeth 1050, the flat section prevents the tube from being pulled out. These teeth 1050 or catches can be designed to be located on one side of the interior of the slot and extend toward the other side, or on both sides of the slot so that the tube could be inserted from both sides of the slot if desired, but still retained in place through the engagement of the tube end with the retaining portions of the teeth or catches. Thus, if the tube is to be inserted from both sides, the gap between the teeth or catch portions must be sufficient to more than accommodate the crimped end 1020 of the tube 1010 so that it may be retained in the gap regardless of how it is inserted. Typically, crimped end 1020 of the tube 1010 has no purpose except to fill the tube from such end and seal it. Normally when you squeeze a tube it goes two ways, one way toward the nozzle and one way toward the crimped end. However, in accordance with the present embodiment, the crimped end 1020 now has a purpose, namely the device attaches permanently to the crimped end 1020 of the tube 1010 and winds up the excess tube and forces the tube contents toward the nozzle end (not shown), and thus the use of the device makes the tube section full from the time it's new until the time its empty. It's like squeezing a brand new tube all way until its empty.

Figure 48:
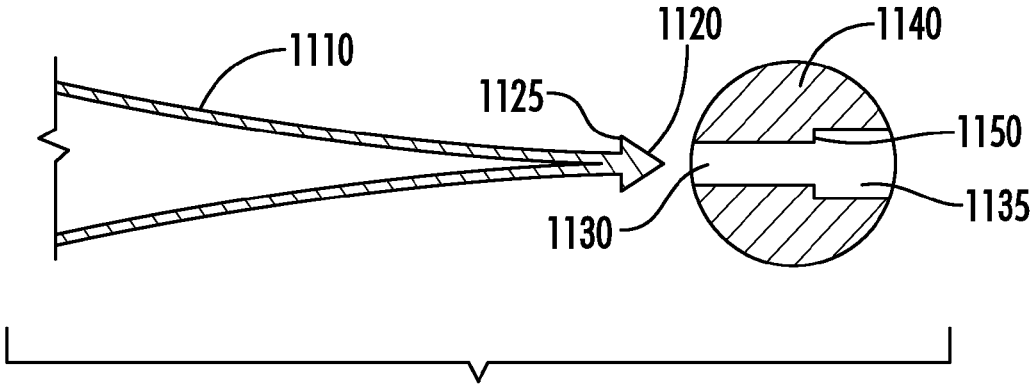
FIG. 48 through 50 illustrates one embodiment of the progressive engagement of a tube with a gripper slot.
Figure 49:
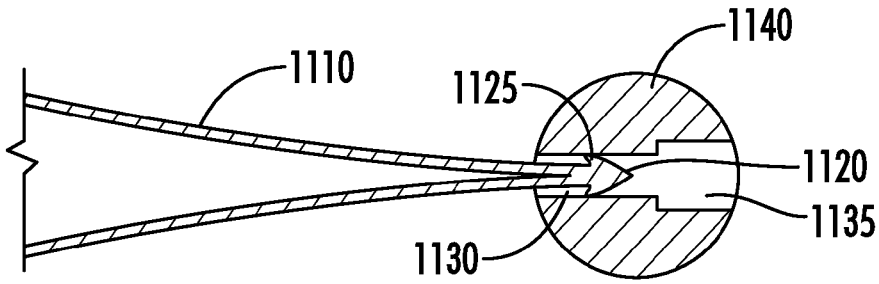
Figure 50:
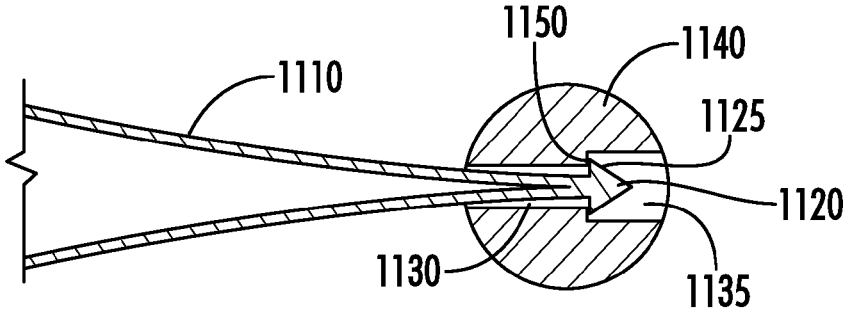

FIGS. 48 through 50 illustrate another embodiment of a tube 1110 having a crimped end 1120 that is inserted into the slot 1130 of a gripper 1140, wherein the slot 1130 has a different type of catch that mates with the crimped end 1120. Specifically, the slot 1130 is provided with a narrowed passageway that causes the tips 1125 of the crimped end 1120 to flex and bend back slightly. Once the crimped end 1120 clears the slot 1130 and enters the gap area 1135, the tips 1125 of the crimped end 1120 flex back and are blocked by inner surfaces 1150 in the gap area 1135 that prevent the crimped end 1120 from being withdrawn back through the slot 1130. This makes the tube and dispenser as one permanent unit.

Aspects of the present invention offer consumers a convenient tube of product that is provided with a wind-up device attached thereto, which may be used to the fullest extent. The tube can be made of 100% plastic along with the wind-up device, making this tube and device combination 100% recyclable, which is another huge benefit especially when there are billions of toothpaste and regular tubes made in the world. The tube can have a stand up cap and can be merchandised on store shelves, so it can eliminate packaging that accompanies the tube. By using the wind up device, it will allow consumers to get almost every drop of the contents out of their tube and prevent premature waste and disposal of unused product out of their tube into land fills. By eliminating the carton and preventing product from being thrown away prematurely, it can save the environment tremendously. This will save landfills and meet the sustainability goals of many companies. In addition to preventing packaging waste, the present device will also eliminate the waste of unused tube contents that typically cannot be dispensed without the use of a wind-up device or the like. The stand up cap can be permanent or removable and can be any shape or design that is known or hereinafter developed.

In one embodiment, the tube can have printing on it or not, can have directions on it or be placed on the body of the wind-up device so when the tube is rolled up, and the consumer can still see the important information on the tube or wind-up device. Such directions can be adhered in an accordion style, so when a consumer needs it it can be unfolded and read, then collapsed and re-adhered to the tube or wind-up device. The tube and/or dispenser can be made of any material, such as opaque or clear plastic material, so the user can see the tube being rolled up. The tube can have markings on it to identify measurements for accurately measuring what is used or how to use, such as for cooking or the like. The tube can have one or more chambers of material that is dispensed through one or more outlets that are delivered by manipulating one or more wind-up devices, or one or more reels or winders within a single wind-up device. The nozzle on the open end of the tube can have type of nozzle known today or developed in the future. The nozzle can be any spreader nozzle known today or developed in the future. The nozzle can be permanent or be removable. The nozzle can have a round opening, oval, angled, jagged, elongated slot opening or any type of shape. It can dispense wide narrow products to fine little products. The tube content can be any type known today. There are too many tube products in the world to mention. Any food product can be put into the tubes as well. Any type of tube product known today can be convenient with this invention.

In one embodiment, there can be a release button (not shown) that disconnects the tube from the wind-up device. It can release the tube from the catches described previously. In one embodiment, the braking device could include a clutch (not shown) which can disengage the braking device and prevent it from braking so that the user can unwind the tube if the clutch device is used. When the clutch is not used the braking device will engage and only turn in the direction that is supposed to be turned to roll up the tube. The clutch can be anywhere on the body or the gripper reel and preferably near the brake and notches. This can be done manually with, for example, a clutch button. The clutch could also be used to reverse the direction of rotation of the brake relative to the body.

In one embodiment, the wind-up device could be provided with a motor built-in (not shown) to automatically wind up a tube attached thereto. This embodiment of the wind-up device could be designed to squeeze a certain amount of contents, for example, a pea sized amount of toothpaste, for example, with the push of a button. The wind-up device may have a place for a motor and batteries (not shown) to be replaced or not. The wind-up device may have a clutch device (not shown) to unwind the tube and disconnect the tube so the user can connect another tube.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A wind-up device for use with a dispenser comprising:

a) a body, a gripper inserted into the body, and a brake disposed between the body and the gripper for controlling the direction of rotation of the gripper relative to the body;

b) the brake further comprises a plurality of fingers for engaging a plurality of body notches on one of the body or the gripper;

c) wherein rotation of the gripper relative to the body causes the fingers to engage and disengage with the body notches at spaced-apart intervals;

d) wherein the brake further comprises an inner diameter and an outer diameter and a plurality of alignment notches formed along the inner diameter, the plurality of fingers having cam surfaces and end surfaces extending from the cam surfaces toward the inner diameter, and wherein the plurality of fingers are biased outwardly relative to the outer diameter and are deflectable downwardly into a tangential relationship with the outer diameter in response to a force applied to the cam surfaces, the plurality of fingers being deflectable into elongated openings defined between the inner and outer diameters; and e) wherein the plurality of alignment notches are angularly displaced relative to the plurality of fingers, the plurality of fingers are arranged at ninety degree intervals around the outer diameter, and the plurality of alignment notches are arranged at ninety degree intervals around the inner diameter.

2. The device of claim 1, where the fingers deflect downward during a transition from engagement to disengagement with the notches.

3. The device of claim 2, where the fingers further comprise cam surfaces that impact edges of the notches and deflect downward during the transition from engagement to disengagement with the notches.

4. The device of claim 3, where the fingers further comprise edge surfaces that seat within the notches and prevent a counter rotation of the gripper relative to the body.

5. The device of claim 4, wherein the notches are provided along a free edge of the body and the brake is seated on the gripper through the engagement of alignment notches on the brake with alignment members on the gripper.

6. The device of claim 5, further comprising a dispenser permanently attached to the gripper.

7. The device of claim 6, wherein the gripper further comprises a retainer and the dispenser further comprises a crimped portion that is retained by the retainer.

8. The device of claim 7, wherein the gripper retainer further comprises at least one tooth and the dispenser crimped portion further comprises at least one opening that is retained by the at least one tooth.

9. A combination dispenser and wind-up device comprising:

a) a dispenser attached to a wind-up device;

b) the wind-up device comprising a longitudinally elongated hollow body having a transverse axis and opposite, substantially flat exterior sides symmetrically arranged relative to the transverse axis and tapering laterally and converging along the transverse axis toward an elongated body inlet at one lateral extremity of the body;

c) said inlet formed by the laterally tapering exterior sides and sized to progressively receive and guide an end portion of the dispenser into an interior of the body, and there being an elongated gripper in the body interior to grip the dispenser end portion, for rotation and progressive wind-up;

d) a winder at one end of the body and operatively connected with the gripper, for rotating the gripper for winding the dispenser closed end, and the flattened tube extent extending from said dispenser end portion, within the body interior; and e) a brake disposed between the body and the gripper for unidirectional rotation of the gripper relative to the body, the brake further comprising a plurality of fingers for engaging a plurality of body notches on one of the body or the gripper;

f) wherein rotation of the gripper relative to the body causes the fingers to engage and disengage with the body notches at spaced-apart intervals;

g) wherein the brake further comprises an inner diameter and an outer diameter and a plurality of alignment notches formed along the inner diameter, the plurality of fingers having cam surfaces and end surfaces extending from the cam surfaces toward the inner diameter, and wherein the plurality of fingers are biased outwardly relative to the outer diameter and are deflectable downwardly into a tangential relationship with the outer diameter in response to a force applied to the cam surfaces, the plurality of fingers being deflectable into elongated openings defined between the inner and outer diameters; and h) wherein the plurality of alignment notches are angularly displaced relative to the plurality of fingers, the plurality of fingers are arranged at ninety degree intervals around the outer diameter, and the plurality of alignment notches are arranged at ninety degree intervals around the inner diameter.

10. The combination of claim 9, the gripper further comprising an elongated slot for receiving the dispenser end portion.

11. The combination of claim 10, wherein the gripper further comprises a retainer and the dispenser end portion further comprises a crimped portion that is retained by the retainer.

12. The combination of claim 11, wherein the gripper retainer further comprises at least one tooth and the dispenser crimped portion further comprises at least one opening that is retained by the at least one tooth.

13. The combination of claim 11, wherein the gripper retainer further comprises a plurality of inwardly directed edges and the dispenser crimped portion further comprises an arrow-shaped portion that is retained by the inwardly directed edges.

14. The combination of claim 9, wherein the wind-up device further comprises a stand for resting the combination on a support surface.

* * * * *